US008181635B2

(12) United States Patent
Ogawa et al.

(10) Patent No.: US 8,181,635 B2
(45) Date of Patent: May 22, 2012

(54) BREATHER DEVICE FOR ENGINE

(75) Inventors: Kazuhisa Ogawa, Wako (JP); Hiroaki Hasebe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 441 days.

(21) Appl. No.: 12/470,594

(22) Filed: May 22, 2009

(65) Prior Publication Data

US 2009/0301449 A1 Dec. 10, 2009

(30) Foreign Application Priority Data

Jun. 5, 2008 (JP) ..... 2008-147722

(51) Int. Cl.

| | |
|---|---|
| ***F02B 25/06*** | (2006.01) |
| ***F02B 25/00*** | (2006.01) |
| ***F02B 33/00*** | (2006.01) |
| ***F01M 1/02*** | (2006.01) |
| ***F01M 13/00*** | (2006.01) |
| ***F01M 9/10*** | (2006.01) |
| ***F01M 1/04*** | (2006.01) |

(52) U.S. Cl. ..... 123/574; 123/41.86; 123/73 V; 123/196 R; 123/196 CP

(58) Field of Classification Search ..... 123/73 V, 123/41.86, 572, 574, 196 R, 196 CP; 137/855, 137/856; 251/331, 358

See application file for complete search history.

(56) References Cited

U.S. PATENT DOCUMENTS

| | | | | |
|---|---|---|---|---|
| 2,864,394 | A * | 12/1958 | Hempel | 137/517 |
| 3,200,838 | A * | 8/1965 | Sheaffer | 137/512.15 |
| 3,255,743 | A * | 6/1966 | Kolbe et al. | 123/574 |
| 4,290,345 | A * | 9/1981 | Hiraga et al. | 92/79 |
| 4,696,263 | A * | 9/1987 | Boyesen | 123/65 V |
| 5,036,806 | A * | 8/1991 | Rarick | 123/65 V |
| 5,243,934 | A * | 9/1993 | Boyesen | 123/73 V |
| 5,647,337 | A * | 7/1997 | Johnson et al. | 123/572 |
| 6,006,786 | A * | 12/1999 | Ito | 137/857 |
| 6,457,449 | B1 * | 10/2002 | Troxler et al. | 123/196 R |
| 7,395,790 | B2 * | 7/2008 | Tiller et al. | 123/65 V |
| 7,520,250 | B2 * | 4/2009 | Leiss | 123/41.86 |
| 7,987,832 | B2 * | 8/2011 | Lin | 123/196 R |
| 2004/0261776 | A1 * | 12/2004 | Knaus et al. | 123/572 |
| 2007/0251512 | A1 * | 11/2007 | Wallington | 123/572 |

* cited by examiner

FOREIGN PATENT DOCUMENTS

JP 64-4812 U 1/1989

*Primary Examiner* — Marguerite McMahon
*Assistant Examiner* — Tea Holbrook
(74) *Attorney, Agent, or Firm* — Westerman, Hattori, Daniels & Adrian, LLP

(57) ABSTRACT

In a breather device for engine, in which an inlet of a breather chamber communicates with a crank chamber through a reed valve, the reed valve being formed of: a fixed stopper plate arranged so as to be opposed to a valve seat formed on an end face of the inlet facing the breather chamber; and an elastic valve plate fixed at one end thereof to the stopper plate and capable of bending elastically to change its position from a closed position in which the elastic valve plate closes the inlet by seating on the valve seat to an opening limit position in which the elastic valve plate opens the inlet and abuts against the stopper plate, the stopper plate is provided at a center part thereof with an oil discharge hole through which oil present between the elastic valve plate and the stopper plate is pushed out when the elastic valve plate is pushed toward the opening limit position in which the elastic valve plate abuts against the stopper plate by pressure in the crank chamber. Accordingly, it is possible to prevent the elastic valve plate from sticking to the stopper plate even if oil mist adheres to the elastic valve plate or the stopper plate of the reed valve.

3 Claims, 3 Drawing Sheets

BREATHER DEVICE FOR ENGINE

CROSS-REFERENCE TO RELATED APPLICATIONS

The present invention claims priority under 35 USC §119 based on Japanese patent application No. 2008-147722 filed Jun. 5, 2008. The subject matter of this priority document is incorporated by reference herein.

BACKGROUND OF THE INVENTION

1. Field of the Invention

The present invention relates to an improvement of a breather device for engine, in which an inlet of a breather chamber communicates with a crank chamber of an engine through a reed valve that allows gas to flow only in one direction from the crank chamber side to the breather chamber side, the reed valve being formed of: a valve seat formed on an end face of the inlet facing the breather chamber; a fixed stopper plate arranged so as to be opposed to and distanced form the valve seat; and an elastic valve plate fixed at one end thereof to the stopper plate and capable of bending elastically to change its position from a closed position to an opening limit position, the closed position being a position in which the elastic valve plate closes the inlet by seating on the valve seat, the opening limit position being a position in which the elastic valve plate opens the inlet and abuts against the stopper plate.

2. Description of the Related Art

Such a breather device for engine is known from Japanese Patent Application Laid-open No. 64-4812, for example.

In the conventional breather device for engine, gas sent under pressure from a crank chamber to a breather chamber includes lubricant oil mist, and the oil mist might adhere to an elastic valve plate or a stopper plate of a reed valve. Such oil mist adherence possibly causes the elastic valve plate to stick to the stopper plate when the elastic valve plate is brought to an opening limit position in which the elastic valve plate abuts against the stopper plate. This might inhibit the closing operation of the elastic valve plate, which is to be performed when the crank chamber is decompressed. As a result, the crank chamber cannot be kept under negative pressure.

SUMMARY OF THE INVENTION

The present invention has been made in consideration of such circumstances, and has an objective to provide a breather device for engine in which an elastic valve plate can be prevented from sticking to a stopper plate even if oil mist adheres to the elastic valve plate or the stopper plate of a reed valve.

In order to achieve the above object, according to a first feature of the present invention, there is provided a breather device for engine, in which an inlet of a breather chamber communicates with a crank chamber of an engine through a reed valve that allows gas to flow only in one direction from the crank chamber side to the breather chamber side, the reed valve being formed of: a valve seat formed on an end face of the inlet facing the breather chamber; a fixed stopper plate arranged so as to be opposed to and distanced form the valve seat; and an elastic valve plate fixed at one end thereof to the stopper plate and capable of bending elastically to change its position from a closed position to an opening limit position, the closed position being a position in which the elastic valve plate closes the inlet by seating on the valve seat, the opening limit position being a position in which the elastic valve plate opens the inlet and abuts against the stopper plate, wherein the stopper plate is provided at a center part thereof with an oil discharge hole through which oil present between the elastic valve plate and the stopper plate is pushed out when the elastic valve plate is pushed toward the opening limit position in which the elastic valve plate abuts against the stopper plate by pressure in the crank chamber.

According to the first feature of the present invention, when the elastic valve plate is pushed up against the stopper plate by positive pressure generated in the crank chamber, oil present between the elastic valve plate and the stopper plate is pushed out toward not only the peripheral edge part of the stopper, but also the oil discharge hole. Accordingly, the oil present between the elastic valve plate and the stopper plate can be reduced speedily and drastically. In addition, the presence of the oil discharge hole allows a small contact area between the elastic valve plate and the stopper plate. Accordingly, the elastic valve plate can be surely prevented from sticking to the stopper plate. Thereby, the elastic valve plate can have improved valve-closing responsiveness to speedily perform the closing-valve operation, and can close the inlet speedily and surely when the crank chamber is decompressed.

Moreover, the oil discharge hole plays another function of applying the pressure in the breather chamber to the elastic valve plate abutting against the stopper plate. Accordingly, when the crank chamber is decompressed, the elastic valve plate is biased toward the valve-closing side by the difference between the pressure in the crank chamber and the pressure in the breather chamber. The elastic valve plate can thus have valve-closing responsiveness improved further.

Further, according to a second feature of the present invention, in addition to the first feature, the stopper plate is provided at a peripheral edge part thereof with paired oil discharge cutouts which are formed side by side with the oil discharge hole between the cutouts.

According to the second feature of the present invention, oil present between the elastic valve plate and the stopper plate can be reduced further speedily and drastically by pushing out the oil present between the elastic valve plate and the stopper plate toward the oil discharge hole and toward the paired oil discharge cutouts. Consequently, the elastic valve plate can be more surely prevented from sticking to the stopper plate.

Further, according to a third feature of the present invention, in addition to the second feature, in the oil discharge hole, a part sandwiched by the paired oil discharge cutouts has a smaller width than other parts.

According to the third feature of the present invention, the stopper plate can be prevented from having less rigidity because of the presence of the paired oil discharge cutouts. Thereby, the stopper plate can rigidly limit the position of the elastic valve plate at the opening limit position.

Here, the inlet and the outlet correspond respectively to an inlet hole 20 and an exhaust pipe 21 of an embodiment of the present invention, which will be described below.

The above description, other objects, characteristics and advantages of the present invention will be clear from detailed descriptions which will be provided for the preferred embodiment referring to the attached drawings.

DESCRIPTION OF THE PREFERRED EMBODIMENT

Figure 2:
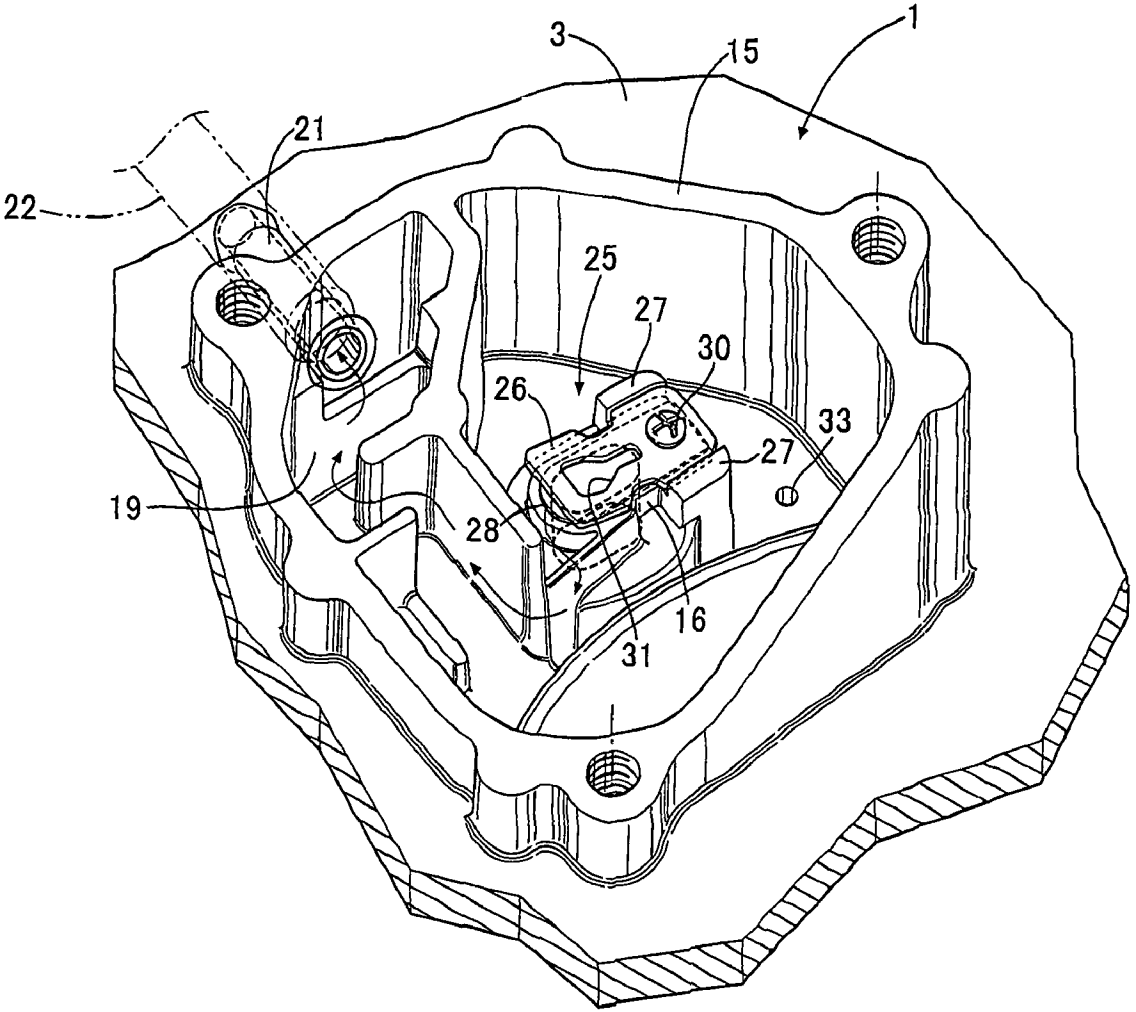
FIG. 2 is a view shown from an arrow 2 in FIG. 1.
Figure 3:
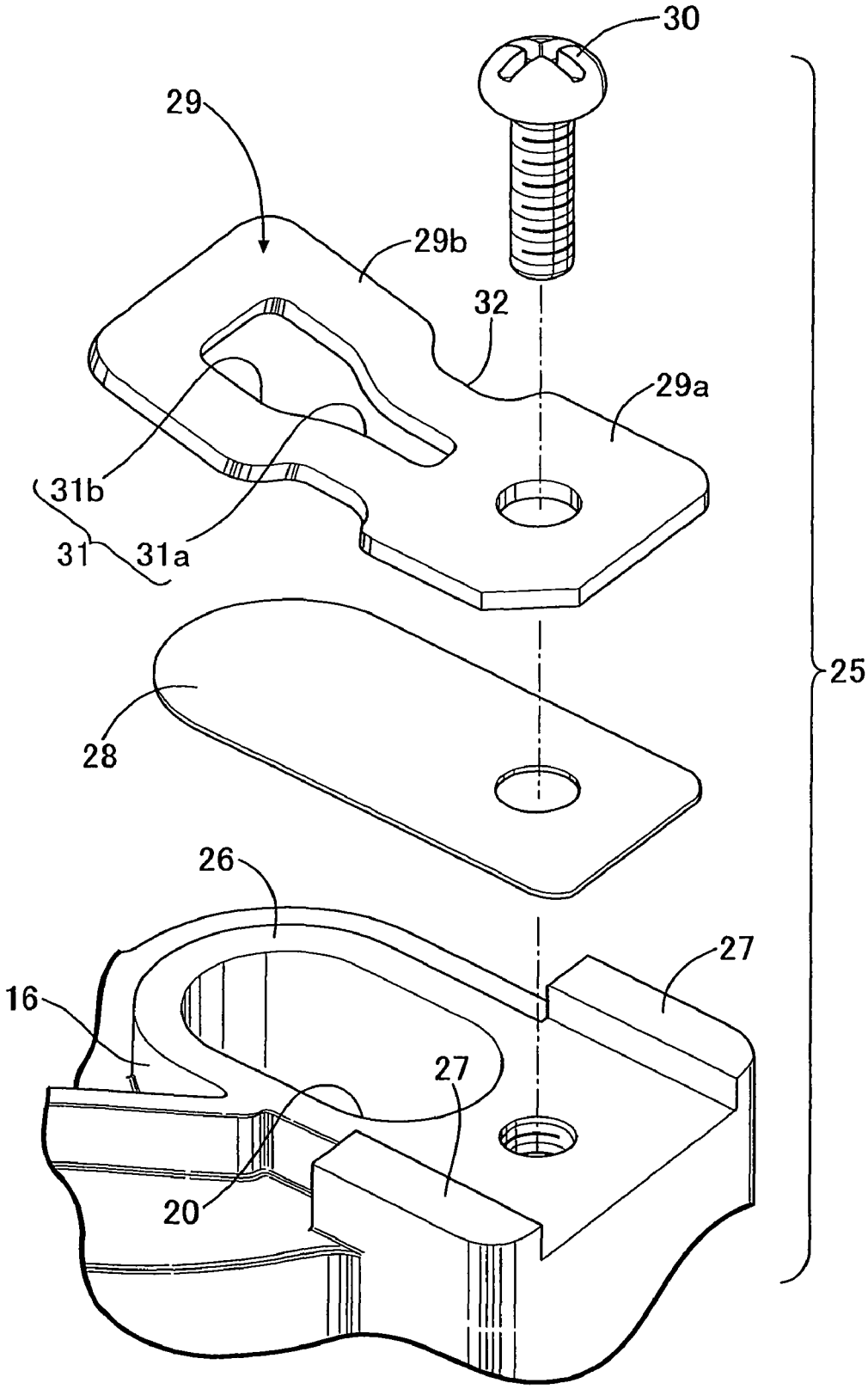
FIG. 3 is an exploded perspective view of a reed valve in the breather device.

An embodiment of the present invention will be explained below with reference to FIG. 1 to 3.

Figure 1:
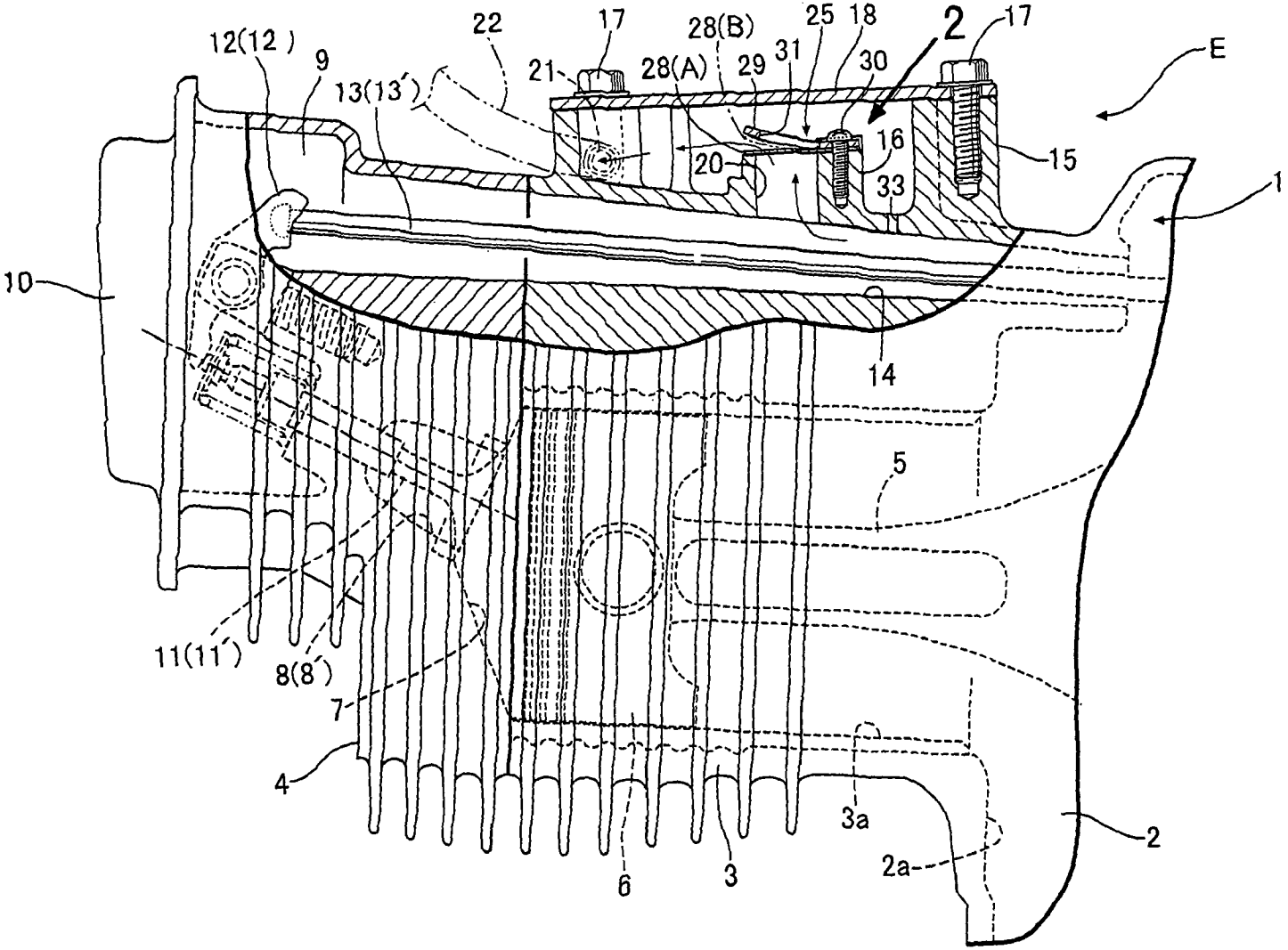
FIG. 1 is a front view of an essential part of an engine showing a breather device of the present invention with the surrounding of the breather device being cut longitudinally.

In FIG. 1, reference numeral E denotes a general-purpose engine. An engine body 1 of the general-purpose engine E is formed of a crankcase 2 supporting a crankshaft (not shown), a cylinder block 3 provided to one side of the crankshaft 2 in a continuous manner and placed substantially horizontally, and a cylinder head 4 joined to an end face of the cylinder block 3. The cylinder block 3 has a cylinder bore 3*a* into which a piston 6 is slidably fitted. The piston 6 is connected to the crankshaft via a connecting rod 5. A combustion chamber 7 and intake and exhaust ports 8 and 8' are formed in the cylinder head 4. The combustion chamber 7 is in communication with the cylinder bore 3*a*, and the intake and exhaust ports 8 and 8' are open to the combustion chamber 7. Moreover, intake and exhaust valves 11 and 11' are attached to the cylinder head 4 to open and close the intake and exhaust ports 8 and 8', respectively.

A head cover 10 is joined to the cylinder head 4, and the head cover 10 and the cylinder head 4 define a valve operation chamber 9 in between. Intake and exhaust rocker arms 12 and 12' are pivotally supported by the cylinder head 4 in a swingable manner. In the valve operation chamber 9, one ends of the respective intake and exhaust rocker arms 12 and 12' are connected to valve heads of the respective intake and exhaust valves 11 and 11'. A camshaft, which is not shown, is connected to the other ends of the intake and exhaust rocker arms 12 and 12' via intake and exhaust push rods 13 and 13', respectively.

The intake and exhaust push rods 13 and 13' are placed in a continuous pass hole 14. The pass hole 14 is provided in a top wall part of the cylinder block 3 and the cylinder head 4 to allow the inside of the crankcase 2, namely, a crank chamber 2*a*, to be communicated with the valve operation chamber 9. The pass hole 14 inclines downward toward the crank chamber 2*a*. This design allows oil mist adhered to the inner peripheral surface of the pass hole 14 to return toward the crank chamber 2*a*.

A breather chamber 15 having an open top face and a boss 16 protruding into the breather chamber 15 are integrally formed on a top wall of the cylinder block 3. The open top face of the breather chamber 15 is closed by a lid plate 18 fixed to the breather chamber 15 by a bolt 17. The boss 16 is provided with an inlet hole 20 which communicates the pass hole 14 to the inside of the breather chamber 15. Moreover, an exhaust pipe 21 is provided to one side wall of the breather chamber 15 at a position as distanced from the inlet hole 20 as possible. The exhaust pipe 21 is open to the outside, and preferably, is open to the intake path of an inlet system (not shown) of the engine E—for example, an air cleaner or a carburetor—through a breather hose 22.

A reed valve 25 is provided on the inlet hole 20 to allow gas flow only in one direction—from the pass hole 14 side, namely, the crank chamber 2*a* side, to the breather chamber 15 side.

With FIGS. 1 to 3, the reed valve 25 will be described.

The boss 16 and the inlet hole 20 are both of elliptical shape in cross section. A flat valve seat 26 and paired positioning walls 27 and 27 are formed in an end face of the boss 16 on the breather chamber 15 side. The positioning walls 27 and 27 are arranged side by side with a longitudinal end part of the valve seat 26 in between. An elastic valve plate 28 and a stopper plate 29 are overlapped at their one end parts and are fitted between the positioning walls 27 and 27. The elastic valve plate 28 is capable of closing the inlet hole 20 by sitting on the valve seat 26, and the stopper plate 29 limits the opening of the elastic valve plate 28. The elastic valve plate 28 and the stopper plate 29 are fastened to the boss 16 by a single bolt 30.

The stopper plate 29 has a flat base part 29*a* and a curved part 29*b*. The base part 29*a* is formed at one end part of the stopper plate 29 and fixed to the boss 16 by the bolt 30. The curved part 29*b* extends from the base part 29*a* toward the other end part while curving away from the valve seat 26. The stopper plate 29 is rigid enough to maintain an opening limit position B of the elastic valve plate 28, which will be described below.

As FIG. 1 shows, the elastic valve plate 28 is capable of bending elastically to change its position between a closed position A and the opening limit position B. In the closed position A, the elastic valve plate 28 sits on the valve seat 26 and thereby closes the inlet hole 20. In the opening limit position B, the elastic valve plate 28 abuts against the stopper plate 29 and thereby opens the inlet hole 20.

An oil discharge hole 31 is provided at a center part of the curved part 29*b* of the stopper plate 29. The oil discharge hole 31 has one half part 31*a* on the bolt 30 side and the other half part 31*b*, and is formed such that the lateral width of the one half part 31*a* is smaller than that of the other half part 31*b*. Paired oil discharge cutouts 32 and 32 are formed in a peripheral edge of the curved part 29*b* in such a manner as to be located side by side with the narrow one half part 31*a* between the cutouts.

In the breather chamber 15, a maze 19 (see FIG. 2) is formed between the inlet hole 20 and the exhaust pipe 21. This design allows oil mist mixed in gas traveling from the inlet hole 20 to the exhaust pipe 21 to be separated from the gas. A small hole 33 (see FIGS. 1 and 2) is provided in a lowermost part of the breather chamber 15 to allow the separated oil to return toward the pass hole 14.

Next, operations of this embodiment will be explained.

While the engine E is in operation, pressure in the crank chamber 2*a* pulsates along with the reciprocating motion of the piston 6. When the crank chamber 2*a* is positively pressurized, the positive-pressure gas pushes up the elastic valve plate 28 of the reed valve 25 from the valve seat 26 to open the inlet hole 20 and then travels to the breather chamber 15 being under atmospheric pressure. When, on the other hand, the crank chamber 2*a* is negatively pressurized, the negative-pressured gas pulls the elastic valve plate 28 toward the valve seat 26. The inlet hole 20 is thus closed to block inflow of outside air to the crank chamber 2*a*. In this way, while the engine E is in operation, the crank chamber 2*a* is kept under negative pressure averagely.

When the positive pressure is released to the breather chamber 15 through the inlet hole 20 opened by the elastic valve plate 28, blowby gas generated in the crank chamber 2*a* travels to the breather chamber 15 through the inlet hole 20 at the same time. Then, the blowby gas is taken into the inlet system of the engine E from the exhaust pipe 21 through the breather hose 22, and is then subjected to a combustion process in the combustion chamber 7 of the engine E along with the air-fuel mixture.

Now, usually, lubricant oil mist drifting in the crank chamber 2*a* and the like is mixed in gas including the blowby gas, which is sent under pressure from the crank chamber 2*a* side to the breather chamber 15. The oil mist is separated from the gas in the course in which the gas travels in the breather chamber 15 from the inlet hole 20 to the exhaust pipe 21. Oil thus separated then flows along the bottom face of the breather chamber 15 down to the small hole 33 to return to the pass hole 14 and then to the crank chamber 2*a*.

Meanwhile, the oil mist carried to the breather chamber 15 along with the gas may adhere to the parts of the reed valve 25. In particular, when the elastic valve plate 28 is pushed by the positive pressure to abut against the curved part 29*b* of the stopper 29 and is thus in the opening limit position B, with the oil mist adhering to the faces of the elastic valve plate 28 and the stopper plate 29 facing each other, a phenomenon tends to occur in which the elastic valve plate 28 sticks to the stopper plate 29. To this regard, in the present invention, since the oil discharge hole 31 is provided at the center part of the curved part 29*b* of the stopper plate 29, when the elastic valve plate 28 is pushed up against the curved part 29*b*, the oil present between the elastic valve plate 28 and the curved part 29*b* can be pushed out toward not only the peripheral edge part of the curved part 29*b*, but also the oil discharge hole 31. Accordingly, the oil present between the elastic valve plate 28 and the stopper plate 29 can be reduced speedily and drastically. In addition, the presence of the oil discharge hole 31 allows a small contact area between the elastic valve plate 28 and the stopper plate 29. Accordingly, the elastic valve plate 28 can be surely prevented from sticking to the stopper plate 29. Thereby, the elastic valve plate 28 can have improved valve-closing responsiveness to speedily perform the closing-valve operation, and can close the inlet hole 20 speedily and surely when the crank chamber 2*a* is decompressed.

Moreover, the oil discharge hole 31 also plays a function of applying the pressure in the breather chamber 15 to the elastic valve plate 28 abutting against the stopper plate 29. Accordingly, when the crank chamber 2*a* is decompressed, the elastic valve plate 28 is biased toward the valve-closing side by the difference between the pressure in the crank chamber 2*a* and the pressure in the breather chamber 15. The elastic valve plate 28 can thus have a valve-closing responsiveness improved further.

In addition, the paired oil discharge cutouts 32 and 32 are formed in the peripheral edge of the curved part 29*b* in such a manner as to be located side by side with the oil discharge hole 31 between the cutouts. Accordingly, the oil present between the elastic valve plate 28 and the stopper plate 29 can be reduced further speedily and drastically by pushing out the oil present between the elastic valve plate 28 and the curved part 29*b* toward the oil discharge hole 31 and toward the paired oil discharge cutouts 32 and 32. Consequently, the elastic valve plate 28 can be more surely prevented from sticking to the stopper plate 29.

Further, the oil discharge hole 31 is formed such that the lateral width of the one half part 31*a* on the bolt 30 side is smaller than that of the other half part 31*b*, and the paired oil discharge cutouts 32 and 32 are formed with the narrow one half part 31*a* between the cutouts. Accordingly, the stopper plate 29 can be prevented from having less rigidity because of the presence of the paired oil discharge cutouts 32 and 32. Thereby, the stopper plate 29 can rigidly limit the position of the elastic valve plate 28 at the opening limit position B.

The present invention is not limited to the above-mentioned embodiment and may be modified in a variety of ways as long as the modifications do not depart from its gist. For example, the breather chamber 15 can be provided to any part as long as the part is in communication with the crank chamber 2*a*, and therefore can be provided to the valve operation chamber 9.

The invention claimed is:

1. A breather device for engine, in which an inlet of a breather chamber communicates with a crank chamber of an engine through a reed valve that allows gas to flow only in one direction from the crank chamber side to the breather chamber side, the reed valve being formed of:

a valve seat formed on an end face of the inlet facing the breather chamber;

a fixed stopper plate arranged so as to be opposed to an distanced from the valve seat; and an elastic valve plate fixed at one end to the stopper plate and capable of bending elastically to change its position from a closed position to an opening limit position, the closed position being a position in which the elastic valve plate closes the inlet by seating on the valve seat, the opening limit position being a position in which the elastic valve plate opens the inlet and abuts against the stopper plate, wherein the stopper plate includes an oil discharge hole through which oil present between the elastic valve plate and the stopper plate is pushed out when the elastic valve plate is pushed toward the opening limit position in which the elastic valve plate abuts against the stopper plate by pressure in the crank chamber.

2. The breather device for engine according to claim 1, wherein the stopper plate includes paired oil discharge cutouts which are formed side by side with the oil discharge hole between the cutouts.

3. The breather device for engine according to claim 2, wherein in the oil discharge hole, a part sandwiched by the paired oil discharge cutouts has a smaller width than other parts.

* * * * *